United States Patent [19]

Tokuji

[11] 4,182,105

[45] Jan. 8, 1980

[54] METHOD OF MANUFACTURING COLLECTIVELY STRANDED WIRES FOR COMMUNICATION CABLES

[75] Inventor: Yoshida Tokuji, Tokyo, Japan

[73] Assignee: Yoshida Kogyo Kabushiki Kaisha, Tokyo, Japan

[21] Appl. No.: 909,906

[22] Filed: May 26, 1978

[51] Int. Cl.[2] ..... H01B 13/02

[52] U.S. Cl. ..... 57/58.54; 57/362

[58] Field of Search ..... 57/58.52, 58.57, 156, 57/58.3, 7, 6, 293, 362

[56] References Cited

U.S. PATENT DOCUMENTS

| | | | |
|---|---|---|---|
| 3,114,232 | 12/1963 | Haugwitz | 57/58.52 |
| 3,138,914 | 1/1964 | Blaisdell | 57/58.52 X |
| 3,147,580 | 9/1964 | Blaisdell et al. | 57/58.52 X |
| 3,309,857 | 3/1967 | Haugwitz | 57/58.52 X |

*Primary Examiner*—John Petrakes

*Attorney, Agent, or Firm*—William Anthony Drucker

[57] ABSTRACT

A method of manufacturing collectively stranded wires for communication cables, comprising a process wherein parallel multi-wire sets obtained by the extrusion method from insulating material and a plurality (2, 3 or 4) of conductor wires arranged in parallel are prepared in such a way that said multi-wire sets are different in color from each other and the number thereof corresponds to that of the conductor wires included in each thereof, and said multi-wire sets are drawn out and separated into element wires which are, after given pre-twisting, sorted into groups each consisting of wires of different colors coming from the corresponding sets and then are wound on bobbins, a process in which said bobbins prepared according to desired number of stranded wires to be collected are mounted on delivery stations of stranding machines through which the wires are stranded and sent out as pairs, 3-conductor or 4-conductor wires, and a process wherein desired number of said stranded wires are collected.

2 Claims, 9 Drawing Figures

(a)

(b)

METHOD OF MANUFACTURING COLLECTIVELY STRANDED WIRES FOR COMMUNICATION CABLES

BACKGROUND OF THE INVENTION

The conventional manufacturing methods of collective stranded wires for communication cables are all dependent on single element wires obtained by extrusion from single conductors and insulating material; said wires are stranded into pairs, 3-conductor wires or quads by corresponding stranding machines and then a desired number thereof are collected to constitute a cable. These methods involve many bobbins and replacement thereof which deteriorates efficiency of the operation. Further, in the whole manufacturing processes, the extrusion has been a bottleneck which, in spite of increased operation speed of the stranding machines etc., determines to a large extent the final efficiency of the operation as a whole.

SUMMARY OF THE INVENTION

The primary object of the present invention is to provide a highly efficient manufacturing method of collective stranded wires for communication cables.

The second object of the invention is to provide a manufacturing method of collective stranded wires for communication cables which permits to considerably reduce the number of bobbins needed in conventional methods, thereby much reducing the time necessary for replacement thereof.

The third object of the invention is to provide a manufacturing method of collective stranded wires for communication cables which, by including an intermittent twisting process, gives excellent electrical characteristics to the cables.

Further objects of the invention will be made clear in the following detailed descriptions.

The present invention relates to a method of manufacturing collective stranded wires for communication cables comprising a process wherein parallel multi-wire sets, obtained by the extrusion method from insulating material and a plurality (2, 3 or 4) of conductor wires arranged in parallel, are prepared in such a way that said multi-wire sets are different in color from each other and the number thereof correspond to that of the conductor wires included in each thereof, and said multi-wire sets are drawn out and separated into element wires which are, after given pre-twisting, sorted into groups each consisting of wires of different colors coming from corresponding sets and then are wound on bobbins, a process in which said bobbins prepared according to desired number of stranded units to be collected are mounted on feeding stations of stranding machines through which the wires are stranded and sent out as pairs, 3-cores and 4-cores, and a process wherein desired number of units of stranded wires are collected.

DETAILED DESCRIPTION OF THE PREFERRED EMBODIMENTS

Figure 1:
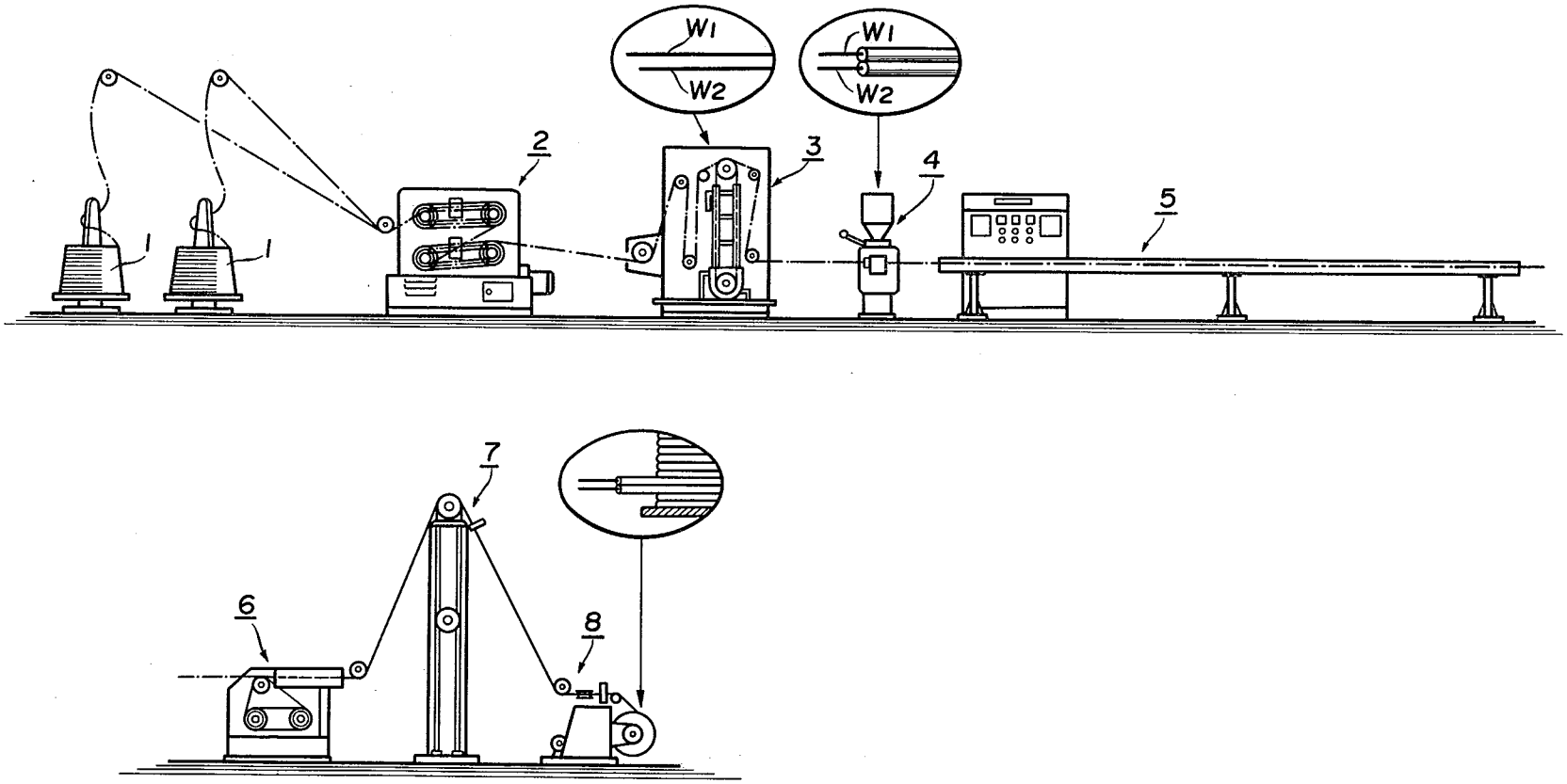
FIG. 1 is a schematic view of an example of the entire assembly of devices for manufacturing parallel multi-wire sets used in the invention.

First referring to FIG. 1, the method of continuously manufacturing parallel multi-wire sets is described. A plurality of conductors (in the drawing two are shown two) forwarded from supply 1 are stretched and thereby contracted in cross sectional area by a stretch machine 2 into element wires $w_1$, $w_2$ of a predetermined diameter, annealed in a device 3, and then fed into an extruding device 4.

The extruding device 4 is a means which provides a single insulation covering 9 on a plurality of conductors (two conductors in this example) arranged in parallel in adjacent position. The element wires thus covered with insulating material are then cooled in a cooling device 5, taken up by a take-up capstan 6 and finally, by way of a dancing roller 7, wound onto a winding device 8. These covered wires wound on the bobbins constitute the parallel multi-wire sets employed in the invention. In FIG. 1, states of the elements wires in the steps of the manufacturing process are illustrated in ellipses.

Now an embodiment of the invention shall be described.

Figure 2:
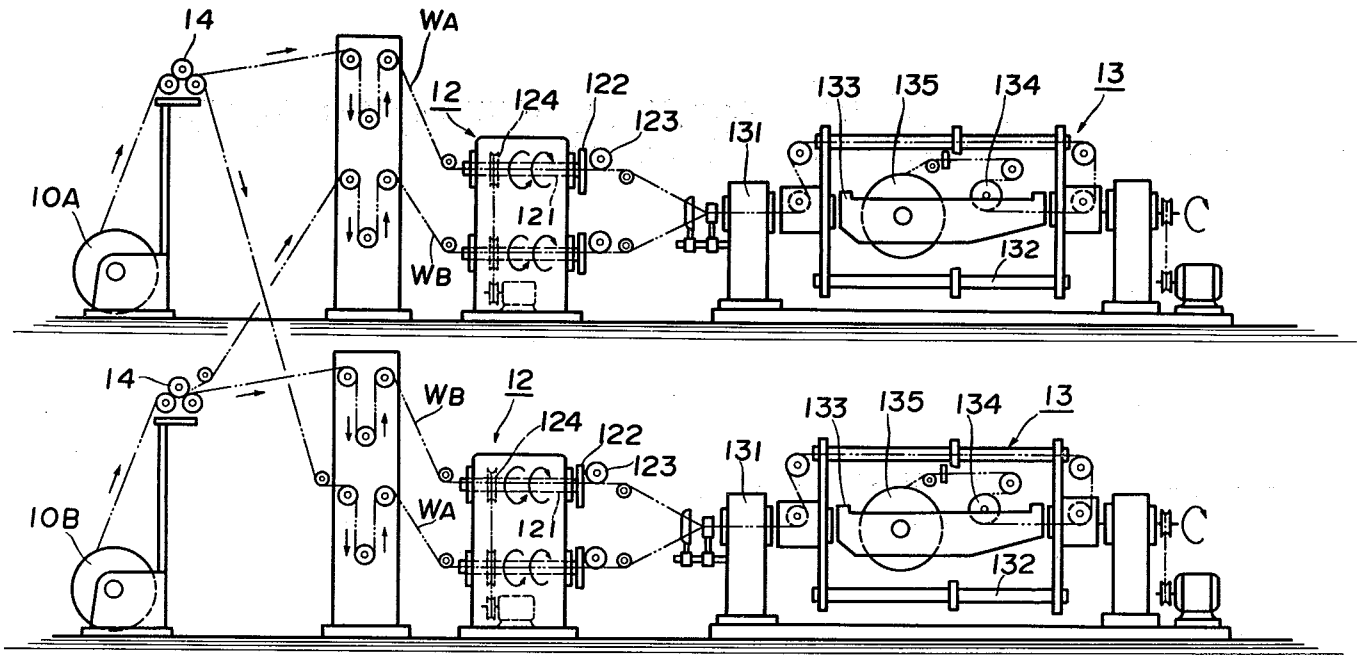
FIG. 2 is an elevation showing diagramatically an example of devices which practise an embodied method of the invention.
Figure 6:
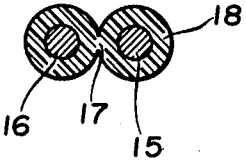
FIG. 6 is a cross section of a parallel multi-wire set, FIG. 7 (*a*), (*b*) show in perspective examples of stranded wires for communication cables manufactured according to the invention.

When communication cables consisting of, for example, paired wires are to be manufactured, firstly two parallel multi-wire sets different from each other in color of insulating material are manufactured according to the method described hereinabove with reference to FIG. 1. The number of element wires in the parallel multi-wire set is arbitrary: in the case of paired wires, the parallel multi-wire set consists of two conductors 15 and 16 covered with insulating material and connected together, as shown in FIG. 6, by a narrow portion 18*a* where they can be easily separated. FIG. 2 shows a device which practises an embodied method of the invention. In the bobbins shown in the left of FIG. 2, there are a pair of bobbins 10A having a parallel multi-wire set with insulating material of color, say, A and 10B having a set with color, say B (or n pairs thereof). The parallel multi-wire sets, after they have passed guide rollers 14, are separated into element coveed wires $w_A$, $w_A$ (having color A and designated in the Figure by solid lines) and $w_B$, $w_B$ (having color B and designated by dotted lines). The two element wires of the multi-wire set can be easily separated, due to easily breakable connection, by pulling the wires in two diverging directions, but, if necessary, separators of wedge-like shape can be employed.

Of the separated element wires, differently colored wires $w_A$ and $w_B$ are individually guided to an intermittent twisting device 12 and are given pre-twisting therethrough. Said intermittent twisting device, which is also an invention of the present applicant and for which patent is being applied as U.S. application Ser. No.

Figure 8:
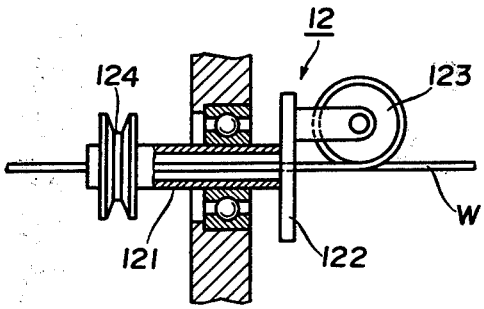
FIGS. 8 and 9 show respectively a verticl sectional views of two examples of devices for intermittent twisting.
Figure 9:
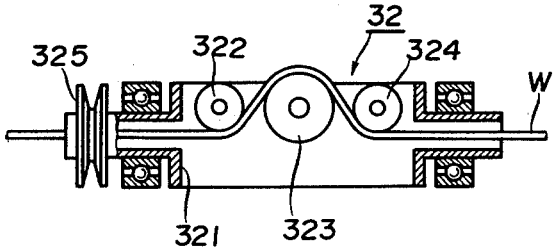

769,243, filed Feb. 16, 1977, now abandoned, comprises, as shown more in detail in FIGS. 2 and 8, a hollow shaft 121 rotatably supported by a frame, and a twisting roller 123 attached thereto through a bracket 122, said twisting roller 123 being arranged in such a manner that the peripheral groove thereof is tangent to the cente axis of said hollow shaft 121 and that the peripheral groove and the center axis are included in a plane. The wire to be twisted is set in such a way as to run in the hollow portion of the shaft 121 and be wound round the roller by at least one turn, and twisting is given thereto by rotating the hollow shaft 121 by means of a pulley 124 about its axis with periodically varying speed of revolution. This is the way by which element wires $w_A$ and $w_B$ are given pre-twisting through the intermittent twisting device 12. The device 32 shown in FIG. 9 is a modification of this intermittent twisting device wherein, on the frame 321 which is driven by a pulley 325 are provided three rolles 322, 323 and 324 which are alternating in diameter and are lined up in the direction of advancement of the element wire, so that the element wire forced through said rollers is prevented from turning back about its own axis.

Next, these element wires $w_A$ and $w_B$ just given pre-twisting are guided to a double-twist stranding device 13 where they are stranded into pairs, and then wound on bobbins 135. Briefly describing the double-twist standing machine, 131 is a base, 132 is a flyer rotatably mounted on said base, 133 is a stationary frame attached to said flyer so as to be rotatable relative thereto, and 134 and 135 are a take-up device and a bobbin provided on said frame 133 respectively.

Thus, the pairs consisting of wires different in color or covering being wound on bobbins 135, when collective stranded wires consisting of these pairs are to be manufactured, it suffices to mount these bobbins on the delivery stations of a stranding machine.

In the method according to the invention employing the devices of FIG. 2, only two bobbins 10A and 10B are needed for supplying element wires, reducing by half the necessary number of bobbins used in the conventional methods which employ single wires.

Now another embodiment of the invention shall be described with reference to FIGS. 3 and 5. According to this modified method, element wires of different colors are wound parallely on a bobbin with a device shown in FIG. 3, then said bobbin is mounted on the delivery station of a stranding machine shown in FIG. 5, and collective cables are manufactured directly therefrom.

Figure 3:
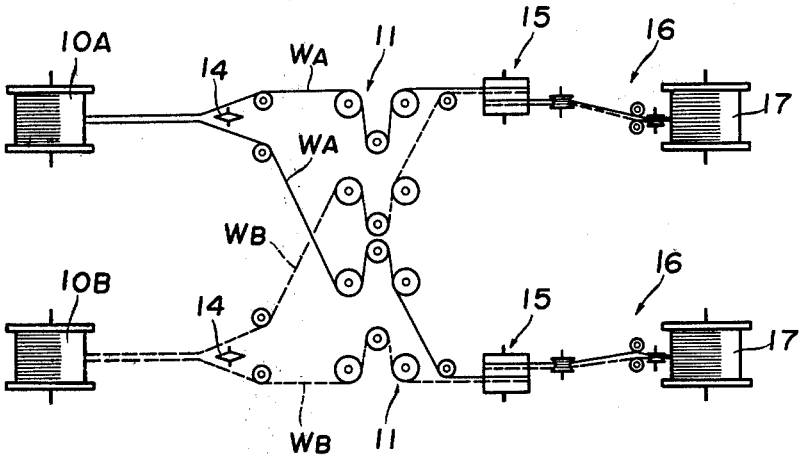
FIGS. 3 and 5 are vertical sectional views showing diagramatically an example of devices used in another embodiment of the invention.
Figure 4:
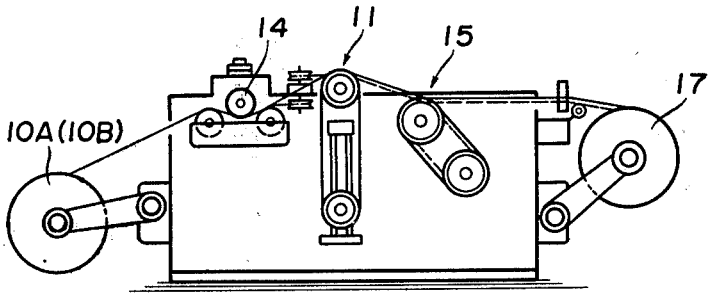
FIG. 4 is a side elevational view of a practical device corresponding to that shown diagramatically in FIGS. 3 and 5.

In FIG. 3, 10A and 10B designate start bobbins similar to those shown in FIG. 2. The parallel multi-wire sets drawn out from said bobbins are separated through separating rollers 14 into individual element wires $w_A$, $w_A$ and $w_B$, $w_B$ and each pair of the element wires of different colors $w_A$ and $w_B$ is taken up by a take-up capstan 15 and then wound orderly on a bobbin 17 by means of a traverser 16. Thus, on each of the bobbins 17 are wound orderly two element wires of different colors A and B. FIG. 4 shows in a side elevational view a practicable form of the device shown diagramatically in FIG. 3.

Figure 5:
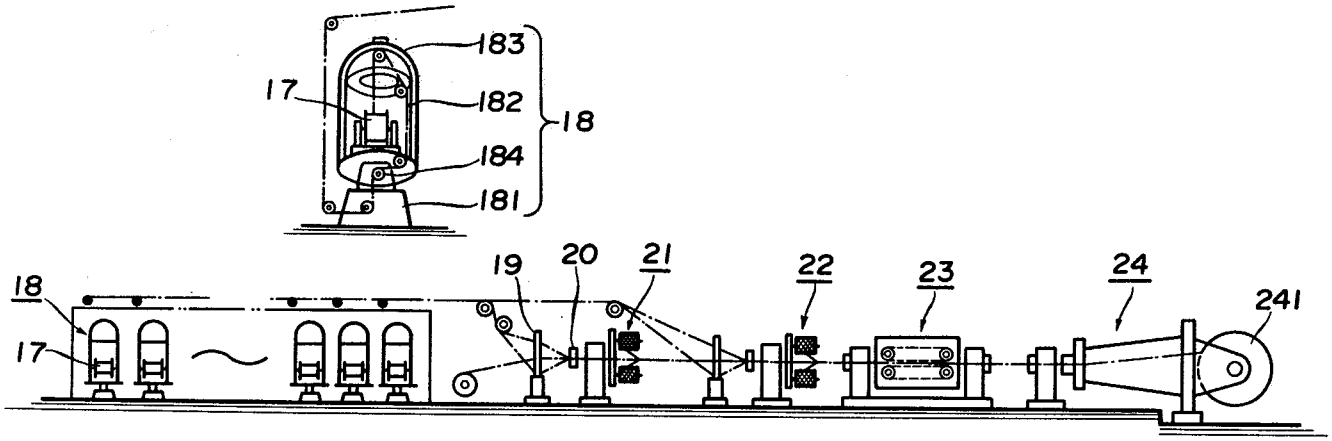
Figure 7:
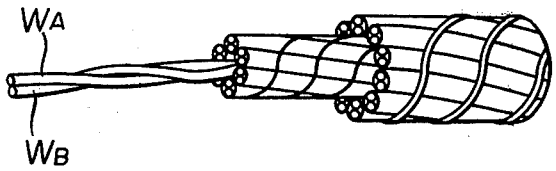
Figure 7:
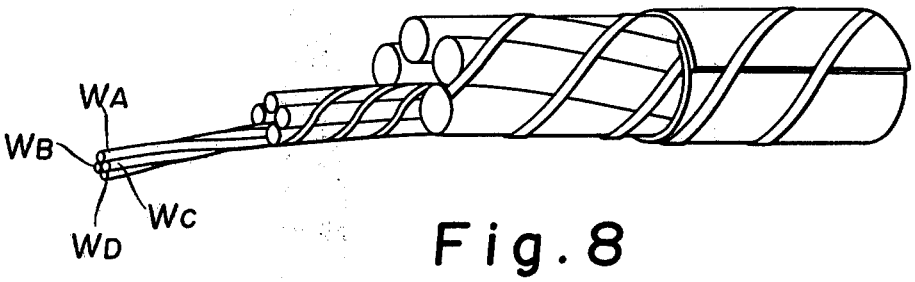

The bobbin is then mounted to a twist-delivery station of a collectively stranding maching shown in FIG. 5, wherefrom the wires are drawn out as twice-twisted pairs. In each of the twist-delivery stations 18, numerals 181, 182 and 183 designate a base, a flyer and a stranding die respectively. The two parallel wires $w_A$ and $w_B$ drawn out from the bobbin 17 are together given first twisting at the stranding die, then run downward along the periphery of the flyer 182, are given second twisting as they depart from the guide roller 184 and enter the base 181, and move toward the collecting station comprising a distribution plate 19 and a collecting die 20. Then the wires are given gross stranding by devices 21 and 22, taken up by a take-up device 23 and finally wound on the bobbin 241 of a winding device 24 as a communication cable. Thus, stranded wires for communication cables as shown in FIG. 7(*a*) are completed.

When stranded wires for communication cables consisting of quads are to be manufactured, four different colors, say, A, B, C and D are selected for insulation covering. Parallel multi-wire sets obtained by an extrusion method from a plurality (3 for example) of conductors and insulating materials corresponding to said four colors respectively are used and equal number of bobbins (say, n bobbins) are prepared for each color. Each of the parallel multi-wire sets is separated into four element wires and every combination of four wires of different colors $w_A$, $w_B$, $w_C$ and $w_D$ coming from the corresponding sets respectively are gathered into a group and wound on a bobbin.

The required number of winding bobbins is calculated by the formula: (number of start bobbins)×(number of element wires in a parallel multi-wire set)÷(number of kinds of color used for insulation covering), and, in the present example, the result is $(4n\times3\div4)=3n$. When the winding bobbins thus prepared are mounted on twist-delivery stations 18 of the collectively stranding machine shown in FIG. 5 and operation is started, the element wires are stranded and delivered as quads, which are further collected into a final quad cable as shown in FIG. 7(*b*) and wound on a bobbin 241 of the winding device.

It should be clear from the description hereinabove of embodiments of the invention that the invention has the effects that (i) high efficiency of manufacturing element wires is attained due to employment of covering method by parallel extrusion; (ii) the stranded wires are excellent as communication cables in electrical characteristics such as low-level crosstalk because of effective intermittent twisting given to each element wire; and (iii) compared with the conventional methods, the number of necessary bobbins at the delivery station and proportionately the time and labor required for replacement thereof can be markedly reduced, thereby greatly reducing on the whole the manufacturing cost of communication cables.

What is claimed is:

1. A method, for the manufacture of collective stranded wires for communication cables, comprising the steps of:

(i) preparing, by parallel extrusion, a plurality of multi-wire sets in which the wires are covered with insulating material, the insulating material of each multi-wire set being of a color which is different from the color of each other such multi-wire set, the number of multi-wire sets prepared being the same as the number of wires in each set;

(ii) dividing each multi-wire set into a plurality of individual wires each covered with said insulating material;

(iii) imparting pre-twist to each of said individual wires;

(iv) composing groups of said pre-twisted individual wires, each group including a pre-twisted individual wire having its insulating material respectively of each of the colors, and (v) severally stranding said groups.

2. A method, for the manufacture of collective stranded wires for communication cables, comprising the steps of:

(i) preparing, by parallel extrusion, a plurality of multi-wire sets in which the wires are covered with insulating material, the insulating material of each multi-wire set being of a color which is different from the color of each other such multi-wire set, the number of multi-wire sets prepared being the same as the number of wires in each set;

(ii) dividing each multi-wire set into a plurality of individual wires each covered with said insulating material;

(iii) imparting pre-twist to each of said individual wires;

(iv) composing groups of said pre-twisted individual wires, each group including a pre-twisted individual wire having its insulating material respectively of each of the colors;

(v) winding said groups onto respective bobbins;

(vi) stranding the wires of a plurality of said bobbins;

(vii) assembling a plurality of said stranded wires.

* * * * *